United States Patent [19]

Schleif et al.

[11] Patent Number: 4,606,665

[45] Date of Patent: Aug. 19, 1986

[54] BALL-POINT PEN WITH INTEGRAL STAMPING EQUIPMENT

[76] Inventors: Ludwig Schleif, Aloys-Schreiber-Str. 61, 7580 Buhl; Kurt Lobstadt, Danziger Str. 26, 7550 Rastatt, both of Fed. Rep. of Germany

[21] Appl. No.: 668,252

[22] Filed: Nov. 5, 1984

[30] Foreign Application Priority Data

Nov. 8, 1983 [DE] Fed. Rep. of Germany ..... 3340293

[51] Int. Cl.[4] ..... B43K 29/00

[52] U.S. Cl. ..... 401/195; 101/333; 401/117

[58] Field of Search ..... 401/195, 117; 101/333

[56] References Cited

U.S. PATENT DOCUMENTS

| | | | |
|---|---|---|---|
| 300,440 | 6/1884 | Blitz | 401/195 X |
| 396,233 | 1/1889 | Reynolds | 101/333 |
| 1,085,143 | 1/1914 | Malsch | 101/333 |
| 2,405,958 | 8/1946 | Kelley | 401/107 X |
| 2,627,227 | 2/1953 | Claggett et al. | 101/333 |
| 4,382,687 | 5/1983 | Lemelson | 401/195 X |

FOREIGN PATENT DOCUMENTS

| | | | |
|---|---|---|---|
| 2827542 | 1/1980 | Fed. Rep. of Germany | 401/195 |
| 2519584 | 10/1981 | France | 401/195 |

*Primary Examiner*—Steven A. Bratlie

*Attorney, Agent, or Firm*—Collard, Roe & Galgano

[57] ABSTRACT

A writing utensil is provided, such as a ball-point pen having integral stamping equipment, which includes:

a stamp and a stamp pad arranged on supports which are articulated by pivoting about axes perpendicular to the longitudinal axis of the writing utensil between positions approximately parallel to the longitudinal axis and positions approximately perpendicular to the longitudinal axis, and a removable cap which friction locks on the supports when the supports are in the position parallel to the longitudinal axis, so that the stamp rests disposed against the stamp pad.

The support for the stamp pivots at its center point on an extension of the rear part of the writing utensil. The extension, rounded off on its outer side, extends to a length corresponding to one-half the length of the stamp support. The stamp pad support is pivotally mounted to the writing utensil shaft and cooperates with a spring-loaded spur rack slidably disposed in the rearward part of the writing utensil to automatically release and pivot out the stamp pad support.

3 Claims, 7 Drawing Figures

BALL-POINT PEN WITH INTEGRAL STAMPING EQUIPMENT

The present invention relates generally to a writing utensil and, more particularly, to a ball-point pen having integral stamping equipment. A stamp and stamping pad are each mounted on supports which pivot around axes perpendicular to the longitudinal axis of the writing utensil between positions approximately parallel to the longitudinal axis and positions approximately perpendicular to the longitudinal axis. A removable cap friction locks over the supports when the supports are in their positions parallel to the longitudinal axis.

Known writing utensils with integral stamping equipment include two basic constructions.

In one of such constructions, a stamp support with a stamp plate disposed upon a stamp pad is loosely inserted in a compartment disposed at and extending from the rear end of the writing utensil. To use the stamping equipment, the cap of the writing utensil is attached to the stamp support as a handle and the stamp is removed from the compartment and used. While the stamp and cap handle of this device can be pressed onto the substrate in the center of the stamp plate, it has the drawback that the stamp must be manually removed from the writing utensil, which means that it may be lost or problems encountered when it is removed from the compartment and the cap not properly fitted thereto.

In the second construction, as specified in German patent DE-GM No. 77 15 261 or German patent DE-GM No. 73 44 137, a stamp and stamp pad are each mounted on supports. Each of the supports is pivotably articulated at one end about an axis perpendicular to the longitudinal axis of the writing utensil between a position approximately parallel to the longitudinal axis and a position approximately perpendicular to said longitudinal axis of the writing utensil. With each of these designs, the stamp and the stamp pad are rigidly connected to the rear part of the writing utensil, such as a ball-point pen, even when the stamp is in use. However, this configuration has the drawback that the stamp support, after it has been lifted up for use, must be pressed onto the substrate with a finger by applying pressure at about its center point. Furthermore, since the two supports for the stamp and the stamp pad are very similar to each other, one cannot exclude the possibility that instead of the stamp, the stamp pad is pressed onto the substrate, especially if the stamping operation is carried out quickly.

Based on such known writing devices having integral stamps, it is an object of the present invention to arrange the stamp and the stamp pad of the aforementioned writing utensil so that immediately after the stamp and stamp pad have been mechanically separated, the stamp is ready for use without requiring the user to use a finger for its operation, thereby enhancing the handling of the stamp.

This object is accomplished by the present invention by a writing utensil of the basic type specified above, which comprises a support for the stamp which pivots at its center on an extension of the rear part of the writing utensil. The extension, rounded on its extremity, extends to a length corresponding to one-half the length of the stamp support. The stamp pad support is provided with a spur gear which cooperates with a spring-loaded spur rack slidably disposed in the rear part of the writing utensil, in a manner such that the stamp pad support is automatically pivoted outwardly when the slidable cap has been displaced or removed.

In addition, since the stamp support is loosely mounted to the extension on the rear of the writing utensil, when the cap is removed or displaced from the supports and the writing utensil held in a vertical position, both the stamp and stamp pad supports automatically swing open. Because of this loose mounting on the extension, the stamp will automatically adjust itself to a horizontal position. With the shaft of the utensil used as a handle, the stamp can be pressed with its center point onto the substrate to be stamped. In this way, the stamp is pressed without the use of a finger, thereby largely eliminating the soiling of fingers with stamping ink.

In order to fold the stamping equipment into a closed position, the axis of the writing utensil is brought into a horizontal position. This causes the longitudinal axis of the stamp support, due to its weight, to automatically return to the longitudinal axis of the writing utensil, without the need for manually adjusting the stamp support. The cap is then used to seize the support for the stamp pad to pivot it back to a position disposed against the stamp support. The cap is then pushed over the supports thereby locking the stamp and stamp pad in this position.

Other embodiments enhance and expand the scope of the writing utensil according to the invention. According to one embodiment, the extension disposed on the rear of the writing utensil is bifurcated in the shape of a fork which is provided with a crosstie across which the stamp support is loosely suspended and a stop is provided to prevent tilting of the stamp support into its rear position.

In a further embodiment, the cap for enclosing the stamping equipment from the rear may be provided at its rear end with an opening, closable by a cover, so that the stamping equipment can be released by pushing the cap in the forward direction over the shaft of the writing utensil.

In another embodiment, the spur rack contains two sides for superior support and displacement. The spur rack may be a folded piece of sheet metal slidably inserted between the spur gear of the stamp pad support and another spur gear or toothed rim.

In a further embodiment, the support of the stamp pad is slightly longer than the total length of the rear extension of the writing utensil and conforms to one-half the length of the support of the stamp. In this way, the stamp pad support can be enclosed within the cap and pivoted against the stamp, so that the cap can then be readily pushed over the folded stamping device.

Other objects and features of the present invention will become apparent from the following detailed description considered in connection with the accompanying drawing, which discloses several embodiments of the invention. It is to be understood that the drawing is to be used for the purposes of illustration only, and not as a definition of the limits of the invention.

In the drawings, wherein similar reference characters denote similar elements throughout the several views.

Figures 1, 2, 3, 4, 5:
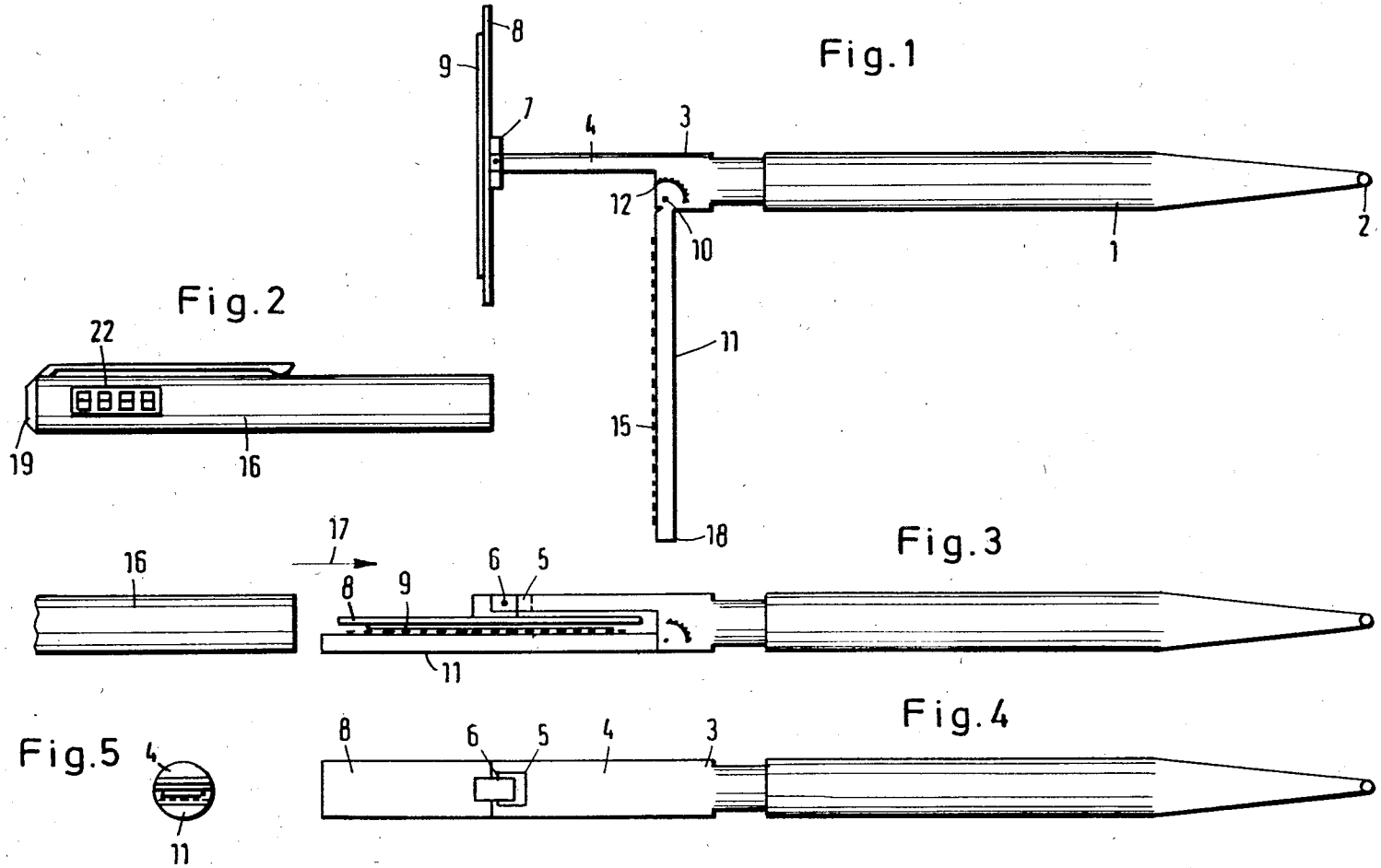
FIG. 1 is a side view of the writing utensil according to the invention with the stamping device folded open.
FIG. 2 is a side view of the cap capable of enclosing the stamping equipment from the rear.
FIG. 3 is a side view of the writing utensil according to FIG. 1 showing the stamping equipment folded together.
FIG. 4 is a view of the writing utensil with the stamping equipment folded together according to FIG. 3, but rotated by 90°.
FIG. 5 is an end view of the folded stamping device according to FIGS. 3 and 4.

Now turning to the drawings, therein is shown a writing utensil according to the present invention comprised of a conventional ball-point pen having a shaft 1 and a movable spring loaded ball-point 2 projecting from its front end, adapted to be pushed out or retracted into shaft 1.

A cylindrical part 3 of the writing utensil is provided with an extension 4 extending axially to the rear of the writing utensil. The extension is provided with a fork-shaped or bifurcated and rounded rear end having an opening 5 and a crosstie 6 extending between the prongs of the bifurcated end. A support 8 for a stamp 9 is loosely suspended on crosstie 6 by means of attachment 7. The length of extension 4 conforms to approximately half the length of stamp support 8.

Figure 6:
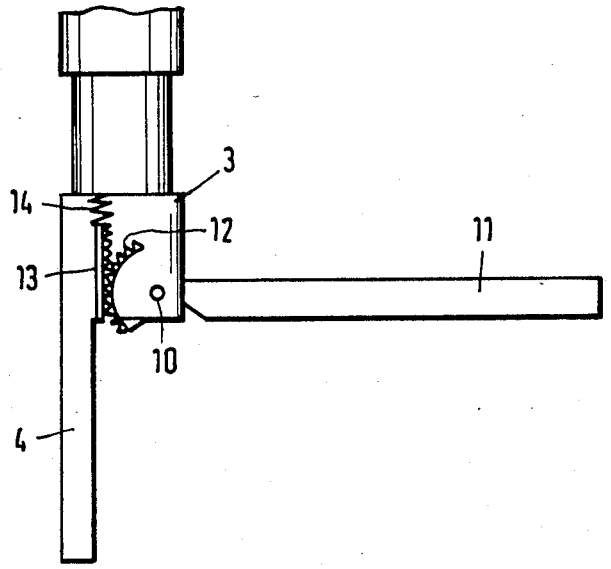
FIG. 6 is an enlarged view of the details of the pivoting mechanism of the stamp pad support.

Stamp pad support 11, which is also rounded on its outside, is pivotally mounted at a first end to part 3 of the writing utensil about an axis 10. Stamp pad support 11 is provided at its first end with a spur gear 12 which engages a spur rack 13. As shown in FIG. 6, spur rack 13 is disposed in the hollow space of cylindrical part 3 of shaft 1 displaceable therein in the longitudinal direction and is spring-loaded by means of a coil spring 14.

In operation, as clearly seen in FIGS. 3 and 4, stamp pad 15 is secured or attached to stamp pad support 11 to rest against stamp 9 and held together by cap 16, which is mounted over the elements in the direction 17 indicated by the arrow in FIG. 3. The rearward removal of cap 16 causes a displacement of spur rack 13 engaging spur gear 12, so that stamp pad support 11 pivots into a position approximately perpendicular to the longitudinal axis of the writing utensil, as shown in FIG. 1.

When using stamp 9, shaft 1 of the writing utensil is brought into a vertical position. Because stamp support 8 and stamp 9, are loosely suspended from crosstie 6 of extension 4, they will assume an approximately horizontal position. Upon the application of vertical pressure on shaft 1, the stamp may then be pressed horizontally onto the substrate to be stamped, thereby permitting a clear and exact reproduction or print of the stamp without the use of a finger or digit by the operator because pressure is applied upon shaft 1 at the center of stamp support 8.

After the stamp has been used, shaft 1 is brought into a horizontal position and stamp support 8, due to its own weight, assumes a position parallel to that of extension 4, as shown in FIGS. 3 and 4. Since the length of stamp pad support 11 slightly exceeds the combined lengths of extension 4 and one-half the length of stamp support 8, extending beyond extension 4, cap 16 is mounted upon end 18 of stamp pad support 11 to pivot support 11 back against stamp 9 and stamp support 8. Thereafter, cap 16 is mounted over and encloses the folded stamping device in the direction of arrow 17.

In another embodiment, cap 16 may be provided at its rearward end with a lockable cover 19, as shown in FIG. 2, permitting cap 16 to be mounted over shaft 1 like a sleeve or jacket. In this way, the stamping device can exit from cap 16 in a rearward direction where it is released and folded apart. To close the utensil again, the cap is simply mounted over the stamping device, causing said device to be folded together again.

Figure 7:
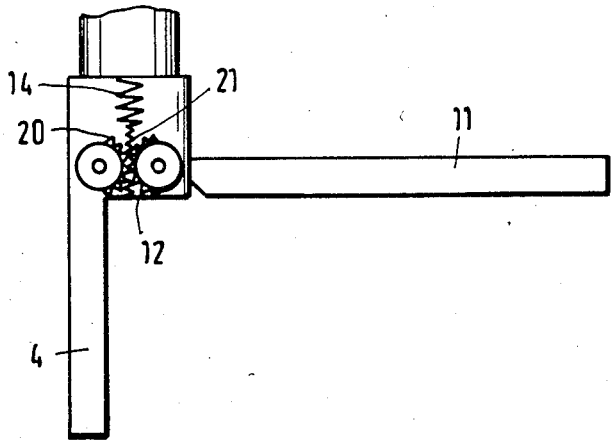
FIG. 7 is an enlarged view of the details of the pivoting mechanism as shown in FIG. 6, in a modified form.

FIG. 7 shows an alternative configuration for the pivoting mechanism of the stamp pad in which a two-sided spur rack 21, having the shape of a folded piece of sheet metal, is displaceably disposed between two spur wheels 12 and 20 in order to ensure superior pivoting.

FIG. 2 shows that with sufficient dimensions of cap 16, the latter may accommodate a small digital clock 22.

While only a few embodiments of the present invention have been shown and described, it will be obvious that many changes and modifications may be made thereunto without departing from the spirit and scope of the invention.

What is claimed is:

1. A writing utensil, such as a ball point pen, having a writing end and a rear end, said writing utensil comprising:

(a) an extension extending longitudinally from said rear end and being rounded on one longitudinal side thereof, the end of said extension being bifurcated and having a crosstie therebetween;

(b) a stamp support supporting a stamp thereon and being freely pivotally mounted at about its longitudinal center on said crosstie to pivot between a position parallel to the longitudinal axis of said writing utensil and a position perpendicular to the longitudinal axis, said extension having a length approximately one-half the length of said stamp support and including a stop to prevent said stamp support pivoting beyond the position perpendicular to the longitudinal axis;

(c) a stamp pad support supporting a stamp pad thereon pivotally mounted at the rear end of said writing utensil to pivot between a position parallel to the longitudinal axis of said writing utensil and a position approximately perpendicular to said longitudinal axis, said stamp pad support having a length which is slightly greater than the combined length of said extension and one-half the length of said stamp support;

(d) a spur gear at the pivoting end of said stamp pad support cooperating with a spring loaded spur rack slidably disposed in the rear end of said writing utensil so that said stamp pad support automatically pivots from said position parallel to the longitudinal axis of said writing utensil to said position approximately perpendicular to said longitudinal axis; and (e) a covering cap slidably mounted on said writing utensil for enclosing said extension, said stamp support and said stamp pad support when said supports are positioned parallel to the longitudinal axis of said writing utensil, said covering cap being adapted to be slidably pushed over said writing utensil to uncover said extension, said stamp support and said stamp pad support.

2. The writing utensil as recited in claim 1, wherein said spur rack has two sides to engage a spur gear associated with the stamp pad support and a spur gear associated with said writing utensil, said spur rack being displaceable by the biasing action of a spring.

3. The writing utensil as defined in claim 1, which further includes a digital clock disposed in the cap.

* * * * *